US008430246B2

(12) United States Patent
Mendelin

(10) Patent No.: US 8,430,246 B2
(45) Date of Patent: Apr. 30, 2013

(54) APPARATUS AND METHOD FOR SIFTING FEEDSTOCK

(75) Inventor: Christoph Mendelin, Lippstadt (DE)

(73) Assignee: Polysius AG, Beckum (DE)

( * ) Notice: Subject to any disclaimer, the term of this patent is extended or adjusted under 35 U.S.C. 154(b) by 569 days.

(21) Appl. No.: 12/598,207

(22) PCT Filed: May 5, 2008

(86) PCT No.: PCT/EP2008/055501

§ 371 (c)(1),
(2), (4) Date: Oct. 30, 2009

(87) PCT Pub. No.: WO2008/135558

PCT Pub. Date: Nov. 13, 2008

(65) Prior Publication Data

US 2010/0116720 A1 May 13, 2010

(30) Foreign Application Priority Data

May 8, 2007 (DE) ..... 10 2007 021 545

(51) Int. Cl.
*B07B 4/00* (2006.01)

(52) U.S. Cl.
USPC ..... 209/137; 209/27; 209/713; 209/714

(58) Field of Classification Search ..... 209/137, 209/142, 143, 146, 134–136, 138–139.2, 209/713, 714, 21–37, 250
See application file for complete search history.

(56) References Cited

U.S. PATENT DOCUMENTS

| | | | | |
|---|---|---|---|---|
| 4,465,194 | A | 8/1984 | Coleman | |
| 5,392,998 | A | 2/1995 | Suessegger et al. | |
| 5,957,299 | A * | 9/1999 | Keuschnigg et al. | 209/135 |
| 2008/0185318 | A1 * | 8/2008 | Konning et al. | 209/473 |

FOREIGN PATENT DOCUMENTS

| | | | |
|---|---|---|---|
| BE | 421021 | A | 5/1937 |
| DE | 263468 | A1 | 1/1989 |
| DE | 4223762 | A1 | 1/1994 |
| DE | 10350518 | A1 | 6/2005 |
| DE | 102005045591 | A1 | 3/2007 |
| EP | 0818249 | A1 | 1/1998 |

* cited by examiner

*Primary Examiner* — Stefanos Karmis
*Assistant Examiner* — Kalyanavenkateshware Kumar
(74) *Attorney, Agent, or Firm* — Gifford, Krass, Sprinkle, Anderson & Citkowski, P.C.

(57) ABSTRACT

The invention relates to an apparatus for sifting feedstock, comprising: a. a static sifter that has a ventilated bottom which is oriented at an angle to the vertical and is penetrated by sifting gas; b. an inlet for feeding the feedstock to the ventilated bottom; c. an outlet for the coarse material; d. a dynamic sifter that is mounted downstream and encompasses at least one rotor with rotor blades and a horizontal rotor axis; e. at least one outlet for the sifting gas loaded with fine material; and f. a housing inside which the static and the dynamic sifter are arranged. The housing area surrounding the dynamic sifter is designed as a housing spiral such that the sifting gas flows against the rotor in a substantially tangential direction. The rotor rotates counter to the direction of flow of the sifting gas in the housing spiral.

7 Claims, 3 Drawing Sheets

APPARATUS AND METHOD FOR SIFTING FEEDSTOCK

Figure 1:
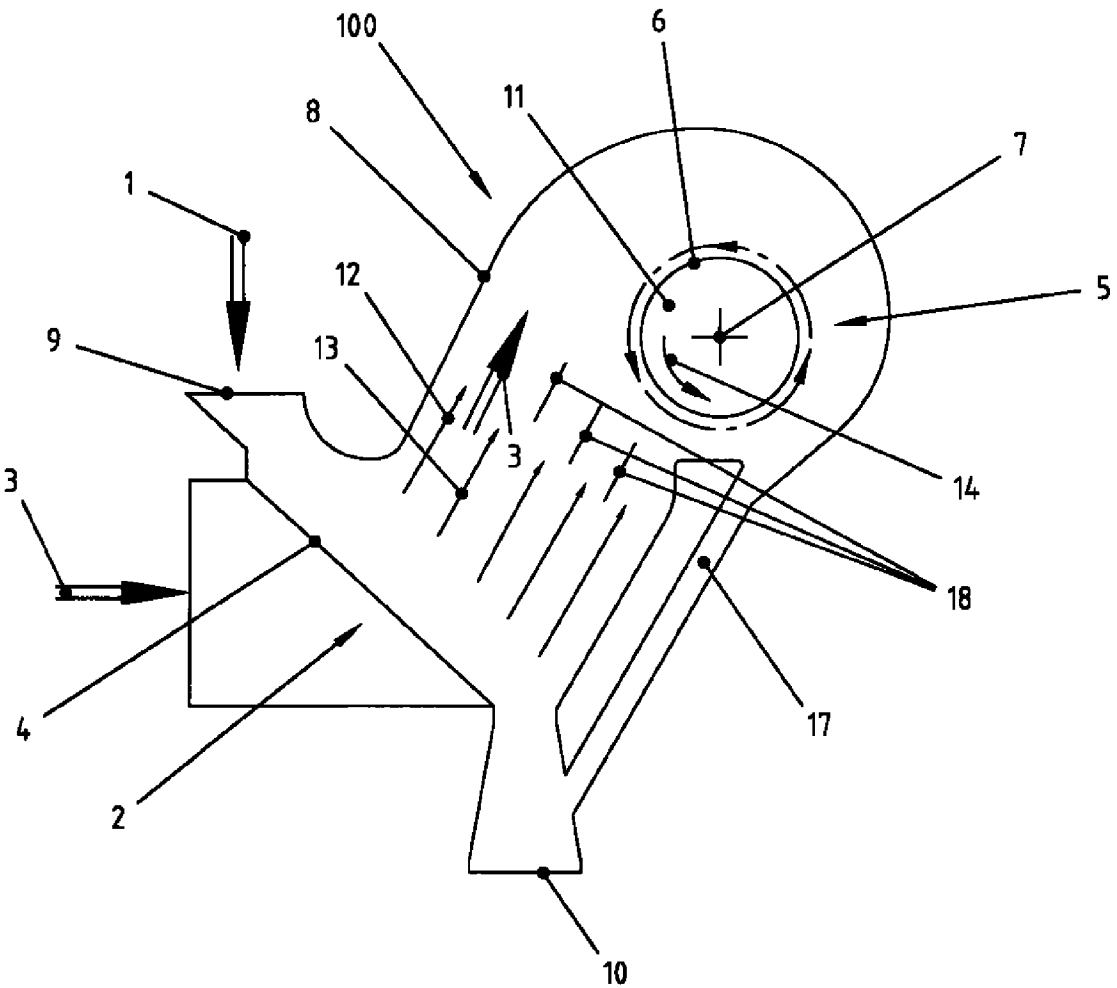

The invention relates to an apparatus for sifting feedstock, having a static sifter comprising an aeration base which is oriented at an angle to the vertical and through which sifting gas flows, and a dynamic sifter which is arranged downstream and which comprises at least one rotor having a horizontal rotor axis.

DE 10 2005 045 591 A1 discloses a grinding installation in which a static sifter is operated directly in front of a dynamic sifter, and a material bed roller mill and/or a tube mill is(are) used as the mill. This type of static-dynamic sifter has proved its worth for specific tasks. The feedstock passes via feeding devices (conveyor belts/chutes) onto the aeration base of the static sifter and then slides downwards via the aeration base.

The sifting air flowing through the feedstock in transverse flow carries the fine material to the dynamic sifter, while the coarse material of the static sifter is discharged by gravity at the lower outlet. The fineness of the fine material of the static sifter can be influenced by altering the sifting air volume flow. In the dynamic sifter, the desired product fineness is adjusted by means of the sifting volume flow and the speed of the rotor.

Owing to structural measures, the sifting air should flow against the rotor substantially tangentially in order to support the centrifugal field built up by the rotor. The tangential incident flow is achieved by a volute configuration of the housing surrounding the dynamic sifter in combination with a dynamic rotor arranged eccentrically with respect thereto. The resultant flow conditions can also be gathered, for example, from DE 103 50 518 A1. The centrifugal force acting on the particles and the sweeping force of the sifting air acting in the direction towards the rotor separate the feedstock of the dynamic sifter into product and coarse material.

Furthermore, DD 263 468 A1 discloses a pneumatic sifter in the sifting chamber of which at least two rod baskets operated in opposite directions of rotation are arranged one above the other in two planes which are perpendicular to the axis of the sifting chamber.

The object of the invention is to improve the sifting efficiency of a static-dynamic sifter.

According to the invention, that object is achieved by the features of claim 1.

The apparatus according to the invention for sifting feedstock basically comprises a. a static sifter having an aeration base which is oriented at an angle to the vertical and through which sifting gas flows,
b. an inlet opening for feeding the feedstock onto the aeration base,
c. an outlet opening for the coarse material,
d. a dynamic sifter which is arranged downstream and which comprises at least one rotor having rotor blades and a horizontal rotor axis,
e. at least one outlet opening for the sifting gas charged with fine material,
f. and also a housing in which the static and the dynamic sifter are arranged, the region of the housing surrounding the dynamic sifter being in the form of a housing volute so that a substantially tangential flow of sifting gas against the rotor results.

The direction of rotation of the rotor is counter to the direction of flow of the sifting gas in the housing volute.

Further forms of the invention are the subject-matter of the subordinate claims.

The rotor blades of static-dynamic sifters are normally oriented radially.

A further increase in the sifter efficiency of the dynamic sifting stage can be achieved by also inclining the rotor blades by from 10 to 50° to the radial direction. The sifter efficiency of the dynamic sifting stage can thereby be improved by 10% or more.

According to a preferred form, guide plates for optimising the tangential flow against the rotor are provided in the region between the static and the dynamic sifter, it being possible for at least one of the guide plates to be arranged in such a manner as to be adjustable.

During the operation of the apparatus for sifting, it has also been found to be especially advantageous if the circumferential speed of the rotor is markedly increased compared with conventional operation, a circumferential speed in the range of from 15 to 35 m/s, preferably in the range of from 20 to 30 m/s, being regarded as especially advantageous.

The above-described apparatus for sifting is especially suitable in a grinding installation having a mill. If, in addition, the mill is formed by a material bed roller mill, the static sifter can be used at least in part to break up, or deagglomerate, the scabs coming from the material bed roller mill.

Further advantages and forms of the invention will be explained in more detail hereinafter by means of the description and the drawings.

In the Drawings

Figure 2:
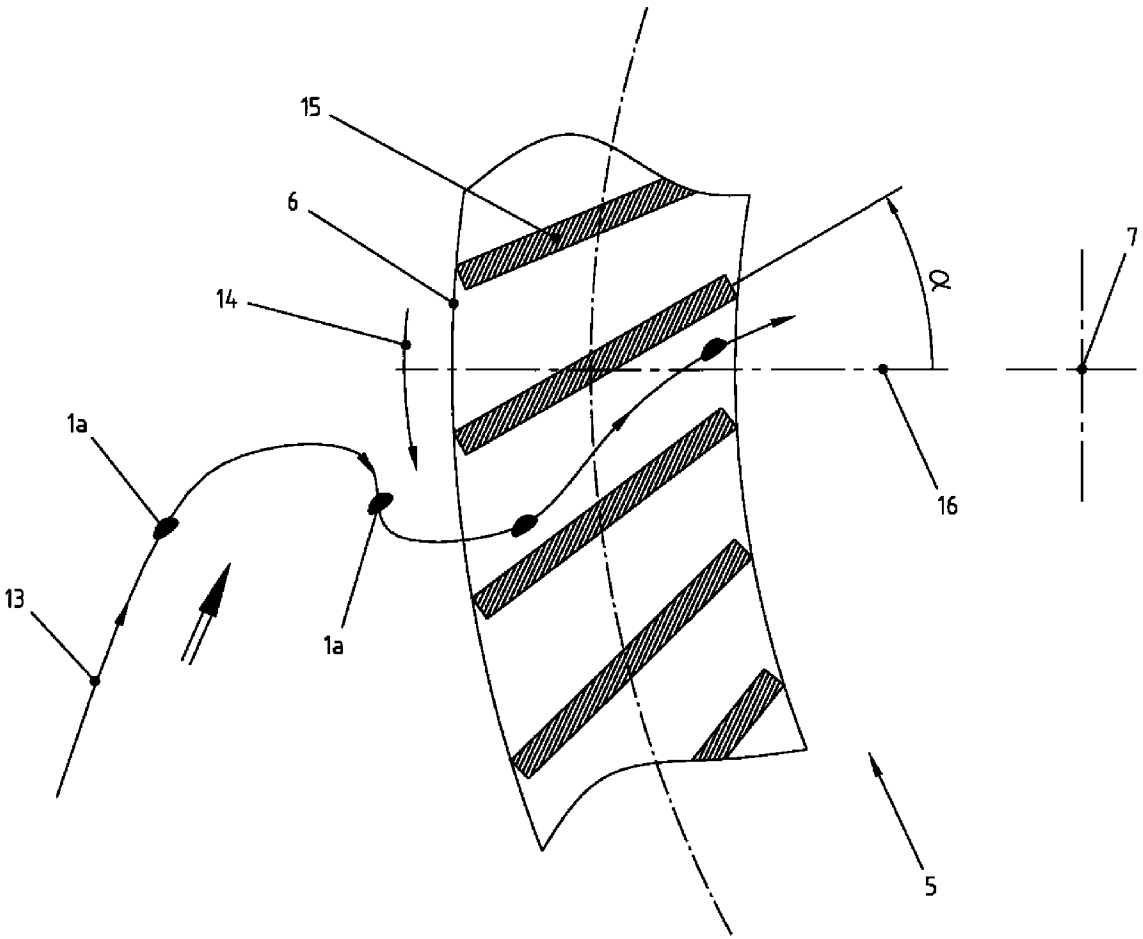
Figure 3:
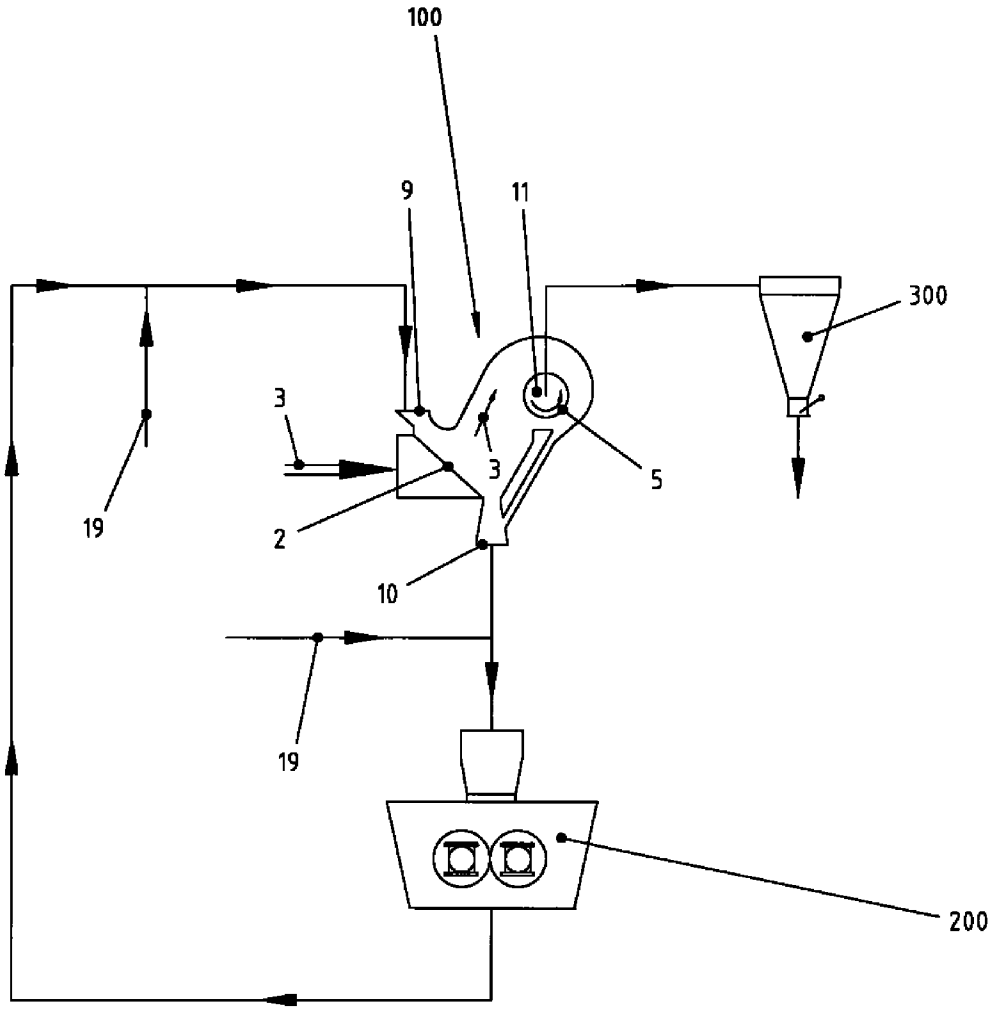

FIG. 1 is a diagrammatic sectioned view of the apparatus according to the invention for sifting feedstock, FIG. 2 is a detailed view in the region of the rotor, and FIG. 3 is a flow diagram of a grinding installation having an apparatus according to the invention for sifting feedstock.

The apparatus 100 shown in FIG. 1 for sifting feedstock 1 basically comprises a static sifter 2 having an aeration base 4 which is oriented at an angle to the vertical and through which sifting gas 3 flows, and a dynamic sifter 5 which is arranged downstream and which comprises at least one rotor 6 having a horizontal rotor axis 7.

The static sifter 2 and the dynamic sifter 5 are arranged in a housing 8 which has an inlet opening 9 for feeding the feedstock 1 onto the aeration base 4, and an outlet opening 10 for the coarse material. Furthermore, an outlet opening 11 is provided for the sifting gas charged with fine material.

The region of the housing 1 surrounding the dynamic sifter 5 is in the form of a housing volute, so that substantially tangential flow against the rotor results (see arrows 12, 13). Therefore, in the embodiment shown, the sifting gas charged with fine material flows substantially clockwise into the housing volute.

The direction of rotation 14 of the rotor 6 is counter to the direction of flow (arrows 12, 13) of the sifting gas into the housing volute, that is to say, in the view according to FIG. 1, the rotor rotates anticlockwise.

It can be seen from the detailed view according to FIG. 2 that the rotor 6 has rotor blades which are so set that they are at an angle $\alpha$ of from 10 to 50°, preferably from 25 to 35°, relative to the radial direction 16, with the rotor blades 15 being offset at their outer circumference relative to the radial orientation in the direction of rotation 14 of the rotor.

During the sifting operation, large portions of the rotor 6 are subjected to tangential incident flow and, as a result of the direction of rotation of the rotor, a centrifugal field rotating in the opposite direction builds up. It therefore becomes necessary for the sifting air (arrow 13) and the particles 1*a* contained therein to perform a sharp turn-around from the clockwise direction into the opposite direction. As a result, a significantly improved sifting outcome becomes apparent. The coarse material of the dynamic stage consequently contains markedly fewer fines, as a result of which the throughput can be substantially improved. The coarse material entrained with the sifting air passes around the rotor and is drawn off via a duct 17 to the outlet opening 10. Optionally, a medium-grain fraction could instead be drawn off separately.

In order to optimise the tangential flow against the rotor 6, guide plates 18 can be provided in the region between the static and the dynamic sifter 2, 5 and are preferably arranged to be adjustable. The guide plates are so oriented that the majority of the sifting air volume flow streams into the housing volute in the clockwise direction. Only a minor portion is drawn in anticlockwise.

The sifting efficiency can be further substantially increased if the rotor 6 rotates substantially faster than in the case of the conventional clockwise direction of rotation, which produces turbulence. The power consumption of the rotor consequently increases accordingly. The higher product fineness which normally results from the higher speed of rotation is avoided by the set of the rotor blades. In the tests on which the invention is based, operation of the rotor 6 at a circumferential speed in the range of from 15 to 35 m/s, preferably in the range of from 20 to 30 m/s, has proved to be especially advantageous.

The above-described apparatus 100 for sifting is suitable for use in a grinding installation together with a mill, especially a material bed roller mill 200. As can be seen from FIG. 3, the coarse material passes from the apparatus 100 via the outlet opening 10, optionally together with fresh material 19, into the material bed roller mill 200. The comminuted material is guided by suitable conveying means, for example a bucket conveyor, to the inlet opening 9 of the apparatus 100 for sifting the feedstock. The fine material is drawn off by way of the outlet opening 11 and conveyed to a separator 100 for separating the sifting air from the fine material.

With the above-described apparatus 100 for sifting feedstock, the sifter efficiency of the dynamic sifting stage can be increased by 10% or more compared with conventional sifters, as described, for example, in DE 10 2005 045 591. The throughput and the electrical energy requirement of a grinding installation having a material bed roller mill can consequently also be substantially improved.

The invention claimed is:

1. An apparatus (100) for sifting feedstock (1), comprising a. a static sifter (2) having an aeration base (4) which is oriented at an angle to the vertical and through which sifting gas (3) flows, b. an inlet opening (9) for feeding the feedstock (1) onto the aeration base (4), c. an outlet opening (10) for the coarse material, d. a dynamic sifter (5) which is arranged downstream and which comprises at least one rotor (6) having rotor blades (15) and a horizontal rotor axis, e. at least one outlet opening (11) for the sifting gas charged with fine material, f. and also a housing (8) in which the static and the dynamic sifter are arranged, the region of the housing surrounding the dynamic sifter (5) being in the form of a housing volute so that a substantially tangential flow of sifting gas against the rotor (6) results, characterised in that the rotor blades (15) are set an angle ($\alpha$) of from 10 to 50° relative to a radial direction (16) of the rotor, the rotor blades being offset at their outer circumference relative to a radial orientation in the direction of rotation of the rotor, and the direction of rotation (14) of the rotor (6) is counter to the direction of flow of the sifting gas (3) in the housing volute.

2. The apparatus according to claim 1, characterised in that guide plates (18) for optimising the tangential flow against the rotor are provided in the region between the static and the dynamic sifter (2, 5).

3. The apparatus according to claim 1, characterised in that at least one guide plate (18) is arranged in such a manner as to be adjustable.

4. A method for sifting feedstock (1) with an apparatus for sifting (100) according to claim 1, characterised in operating the rotor (6) in a direction of rotation (14) which is counter to the direction of flow of the sifting gas (3) in the housing volute.

5. The method according to claim 4, characterised in operating the rotor (6) at a circumferential speed in the range of from 15 to 35 m/s.

6. A grinding installation having a mill and an apparatus for sifting (100) according to claim 1.

7. The grinding installation according to claim 6, characterised in that the mill is formed by a material bed roller mill (200).

* * * * *